US005129989A

United States Patent [19]

Gosset et al.

[11] Patent Number: 5,129,989

[45] Date of Patent: Jul. 14, 1992

[54] MANUFACTURING PROCESS FOR PAPER

[75] Inventors: Serge Gosset, Lestrem; Pierre Lefer; Guy Fleche, both of Merville; Jean Schneider, La Gorgue, all of France

[73] Assignee: Roquette Freres, Lestrem, France

[21] Appl. No.: 670,390

[22] Filed: Mar. 15, 1991

Related U.S. Application Data

[63] Continuation of Ser. No. 410,503, Sep. 21, 1989, abandoned, which is a continuation of Ser. No. 166,921, Mar. 11, 1988, abandoned.

[30] Foreign Application Priority Data

Mar. 13, 1987 [FR] France ..... 87 03481

[51] Int. Cl.[5] ..... D21H 11/14; D21H 17/28

[52] U.S. Cl. ..... 162/147; 162/175; 162/183

[58] Field of Search ..... 162/175, 183, 147

[56] References Cited

U.S. PATENT DOCUMENTS

| | | | |
|---|---|---|---|
| 3,067,088 | 12/1962 | Hofreiter et al. | 162/175 |
| 3,269,852 | 8/1966 | Borchert et al. | 162/175 |
| 4,066,495 | 2/1978 | Voigt et al. | 162/175 |
| 4,487,657 | 12/1984 | Gomez | 162/183 |

OTHER PUBLICATIONS

Tappi, vol. 65, No. 3, mars 1973, pp. 83–86, Atlanta, Georgia, US; K. W. Britt: "Retention of additives during sheet formation" p. 85, The Two-step Method; tableau III.

Casey, *Pulp and Paper*, 3rd ed., vol. III (1981) p. 1493.

*Primary Examiner*—Peter Chin

*Attorney, Agent, or Firm*—Larson and Taylor

[57] ABSTRACT

A process for manufacturing paper is characterized by the fact that there is introduced into the fibrous composition constituting the starting or raw material, at two or several points, particularly in the wet end, separately from one another, one (or several) cationic starch(es) and one (or several) anionic starch(es) other than a starch phosphate.

16 Claims, 1 Drawing Sheet

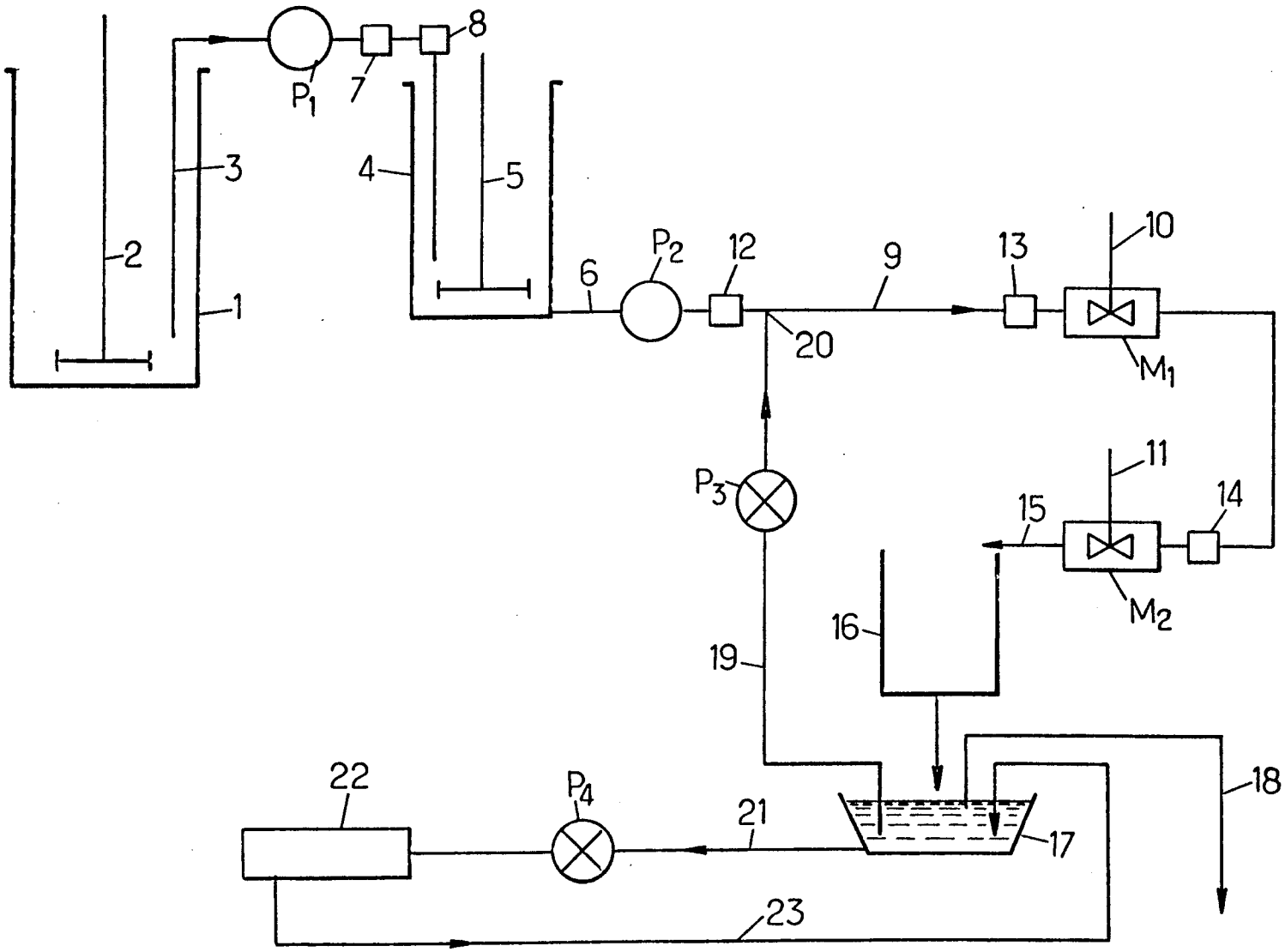
1
2
3
4
5
6
7
8
9
10
11
12
13
14
15
16
17
18
19
20
21
22
23
$P_1$
$P_2$
$P_3$
$P_4$
$M_1$
$M_2$

MANUFACTURING PROCESS FOR PAPER

This application is a continuation of application Ser. No. 410,503 filed Oct. 21, 1989 now abandoned which is a continuation of application Ser. No. 166,921 filed Mar. 11, 1988 (now abandoned).

BACKGROUND OF THE INVENTION

The invention relates to a manufacturing process for paper, the word "paper" denoting, in the following any flat structure or sheet not only based on cellulose fibers—the most frequently raw material used in the paper and cardboard industry—but also on the basis of

- synthetic fibers such as polyamide, polyester and polyacrylic resin fibers,
- mineral or inorganic fibers such as asbestos, ceramic and glass fibers,
- any combination of cellulosic, synthetic and inorganic fibers.

The well-known use of cationic starches which are introduced into the fiber mass before the formation of the sheet, has permitted increase in the retention of the fibers and of the fillers, improvement in the draining and increase in the physical characteristics of the paper; in fact, the preferential fixation of these starches to the anionic reaction sites of the fibers and of the fillers, made possible by their cationic character or cationicity, enables the number of bonds between fibers to be increased as well as between fibers and fillers, whence a greater strength of the paper; and due to this greater strength of the paper, it became possible to reduce the concentration of the fiber mass or to resort to lower quality fibers.

Now, the advantages procured by the employment of cationic starches do not always permit, since a couple of years, compensation of the increasing drawbacks created by the increasing degradation in the quality of starting or raw materials.

In fact, to face up to stricter and stricter concerns of economic profitability, not only the semichemical pulp traditionally used, for example, for the manufacture of the paper for corrugated cardboard has seen its part reduced to the profit of pulps derived from recovered cellulose fiber, commonly called RCF, but in addition the quality itself of this RCF is more and more mediocre by reason of the increasing number of recyclings of "old paper".

To this is added the fact that at the level of paper machines, the tendency is more and more towards the systematic closing of circuits, whence an enrichment of the manufacturing liquors with organic and inorganic substances.

These factors cooperate to the reduction in the solidity of the paper; the proportion of cationic starches which can be fixed to the fibers decreases, whence a lower strength of this sheet.

Various solutions have been proposed to overcome these drawbacks.

Thus, starches have been developed characterized by a cationicity which is higher and higher, but which is quite obviously limited by the maximum cationicity that can be achieved by conventional processes of producing cationic starches. And in any case, whatever the degree of cationicity, the closure of circuits and the degradation of the quality of the fibers is manifested by an ineluctable lowering in the strength of the papers.

Knowing that the effectiveness of a cationic starch is all the greater as its probability of fixation of the fiber is greater, recourse has been had (see U.S. Pat. No. 4,066,495) to increase this probability of fixation, to associations of the "cationic starch—polyacrylamide" or "cationic starch—aluminum sulfate or aluminum polychloride" type.

This use of two or several compounds of the same ionicity has only in fact the sole object of increasing the retention of the fillers and of the fibers without however modifying the composition of the paper.

Within the same order of ideas, starches have been resorted to (see Patent FR 1,499,781) containing both cationic groups and anionic phosphate groups.

These starches, although comprising consequently, groups of different ionicity, have in spite of all, an essentially cationic character, involving consequently their own limits of utilisation.

The successive application of a starch phosphate and of a cationic starch only permits improvement in the strength of the paper obtained and this in an insufficient proportion. In addition, these phosphated starches contribute to increasing the polluting charge through the presence of nitrogen compounds evolved in their manufacturing process.

In so called "dual" techniques, it is not to starches comprising both cationic groups and phosphate groups or to the employment of starch phosphates and of cationic starches that recourse is had, but to associations of cationic starches that recourse is had, but to associations of cationic starches and compounds of different ionicity.

Thus (see EP 41,056) cationic starches have been used in association with colloidal silicic acid; besides, the patent EP 60,291 discloses the preparation of a gel based on cationic starch and carboxymethylcellulose or of an uronic acid polymer, this gel being partly dehydrated by the action of a colloidal solution of polysilicic acid or of an oxypolyaluminum compound.

The dual techniques lead to an improvement in retention, thus permitting the manufacture of a paper with a higher content of fillers. They permit a substantial economy in cellulose, but are not applicable in all cases. Moreover, the amount of starch fixed to the cellulose at the time of formation of the sheet remaining still limited, the physical characteristics of the paper so obtained are not always improved sufficiently.

To obtain a paper having increased mechanical characteristics, it is consequently necessary to subject the paper produced according to one of the preceding techniques, to a surface treatment carried out, particularly in a machine of the "size-press" type; such a treatment permits the proportion of starch entering into the constitution of this paper to be increased, thus conferring on it a better strength.

Now such a solution is not satisfactory from the economic point of view, any additional operation being expensive; passage in a "size-press" results besides in a considerable reduction, of the order of 15 to 20%, in the speed of the machines and hence in paper production.

It results from the foregoing that none of the existing processes leads, at a satisfactory cost price, to the production of paper having the desired characteristics.

It is therefore a particular object of the invention to provide a paper manufacturing process responding better to the various desiderata of practice than those existing hitherto.

GENERAL DESCRIPTION OF THE INVENTION

Now Applicants have observed, following thorough investigations, that it became possible, particularly under reputedly difficult conditions, to increase substantially, that is to say by at least 30% even by 50% or even by more than 100%, the limiting threshold of fixation of starch in the fibrous composition when there is introduced into the fiber mass, particularly in the wet end, separately from one another, a cationic starch and an anionic starch other than a starch phosphate.

By the expression "limiting threshold of fixation of starch in the fibrous composition" is meant the amount of starch fixed per unit weight of dry fibrous composition, the latter comprising the whole of the insoluble constituents serving for the formation of the paper sheet.

It follows that the manufacturing process according to the invention is characterized by the fact that there is introduced into the fibrous composition constituting the starting or raw material, at two or several points, particularly in the wet end, separately from one another, one (or several) cationic starch(es) and one (or several) anionic starch(es) other than a starch phosphate.

According to an advantageous embodiment of the abovesaid process, the anionic starch other than a starch phosphate, is selected from the group comprising starch phosphonates, carboxyalkylated starches and, preferably, starch sulfates, sulfoalkylated and sulfocarboxyalkylated starches. In the following, the expression "anionic starch" denotes any product of this type with the exception of starch phosphates.

According to another advantageous embodiment of the abovesaid process, there is added to the fibrous composition constituting the starting material intended for the manufacture of paper, an amount of 0.2% to 5% of cationic starch and an amount of 0.2% to 5% of anionic starch.

Preferably, the amounts of cationic and anionic starch are comprised between 0.4 and 3%, more preferably between 0.7% and 2.5%, the percentages being expressed as dry starch with respect to the dry fibrous composition.

The cationic and anionic starches are advantageously introduced into the fibrous composition in the form of a dilute aqueous size or glue of concentration less than 5%, preferably less than 3% and, more preferably, less than 1%, the lower limit being 0.01%.

The preparation of the sizes (if the starch used is not directly soluble in cold water, in which case a simple dispersion in water suffices) is produced in a manner known in itself by batchwise or continuous cooking, for example in a continuous cooker under pressure adapted to ensure the operations of measuring out, cooking and dilution.

According to an advantageous embodiment of the invention, recourse can be had, in order to simplify the process according to the invention, to anionic or cationic starch directly soluble in cold water; in this case, the said starches directly soluble in cold water can be introduced, in form of a powder, directly in the fibrous suspension.

According to another advantageous embodiment of the process according to the invention, the proportion of cationic starch with respect to the anionic starch must be comprised between 10/1 and 1/10, preferably between 5/1 and $\frac{1}{3}$ and, more preferably still, between 3/1 and $\frac{1}{2}$, these ratios being expressed as a dry weight of starch.

The addition point of the cationic and anionic starches is defined according to the physico-chemical characteristics of the system, this choice being manifested by different values of the contact time with the fibrous composition.

The optimal concentrations of cationic starch and of anionic starch employed according to the invention, that is to say those enabling better performance to be obtained, are determined within the limits indicated, as a function particularly of the weight of fibers used, and of the aqueous medium employed (ionic environment) or of the particular characteristics of each paper machine.

Within these limits, the performances inherent to the invention as measured, for example, by means of the retention test of the starch, are superior to those which could be expected by simple addition of the individual performances relating to the employment respectively of cationic starch or anionic starch, showing, consequently, a synergic effect.

The cationic starches employed according to the invention are selected from among those having an acceptor electron state, obtained by means of substituent groups of an electropositive nature, called cationic.

The substituents most currently used are those containing a tertiary or quaternary nitrogen atom, although phosphonium and sulphonium groups could also be used.

As reagents for the cationisation of starch, there may be used halohydrins or epoxides corresponding respectively to the following formulae:

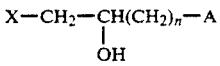

and

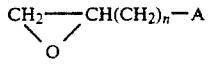

in which

A represents the groups:

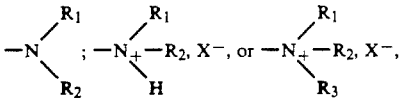

X representing in the abovesaid formulae a halogen atom, such as, for example, chlorine, $R_1$ and $R_2$ each represent, independently of one another a straight or branched chain alkyl radical of $C_1$–$C_4$ or are joined in a ring structure, $R_3$ represents an alkyl radical with a straight or branched chain of $C_1$–$C_4$ and n represents a whole number from 1 to 3. The cationisation reagents used are preferably:

diethylamino chloroethane, trimethylammonium epoxypropyl chloride, trimethylammonium chloro-1-hydroxy-2-propane chloride.

The electrophilic strength of these starches is quantified by measurement of the degree of substitution (DS), that is to say the number of hydroxyl functions which have been substituted per elementary glucose unit. As a general rule, the DS is at the most equal to 0.3; it is preferably comprised between 0.02 and 0.20 and, more preferably, between 0.04 and 0.15.

For the preparation of the anionic starches employed according to the invention, the anionic substituents are introduced into the starch molecule by resorting to functional reagents among which are preferably:

- in the case of starch phosphonates, aminochlorethane diethylphosphonic acid,
- in the case of starch sulfates, sulfamic acid, sulfamates or again electron donor $SO_3^-$ complexes such as $SO_3$-TMA (trimethylamine), $SO_3$-pyridine,
- in the case of starch sulfoalkyls, 2-chlorethane-sulfonates and 3-chloro-2-hydroxypropanesulfonate,
- in the case of starch carboxyalkyls, salts of 1-halocarboxylic acids such as sodium monochloracetate or sodium chloropropionate, lactones like propiono- or butyrolactone, acrylonitrile (reaction followed by a saponification), acid anhydrides such as maleic, succinic, phtalic anhydrides and the like,
- in the case of starch sulfocarboxyls, 3-chloro-2-sulfopropionic acid.

Although the strength of the nucleophilic power of the starches containing anionic groups should, in theory, be specified by the value of the pKA, in practice it is the DS which is measured.

The maximum value which the DS can reach is equal to 3. However, as a general rule, a DS at the most equal to 1.5 and, preferably, at the most equal to 0.5, will be reserved for the anionic products sought for the practice of the invention.

The fixation of starch of a reagent bearing a cationic or anionic group is well know [see:

- "Starch: Chemistry and Technology", edited by Whistler et al, vol. II (Industrial aspects), 1967, Academic Press;
- "Starch Production Technology", edited by J. A. Radley, 1976, Applied Science Publishers Ltd. London;
- "Starch: Chemistry and Technology", edited by Whistler et al, 2nd edition (1984), Academic Press, Inc., pages 354–385].

In the present state of the art, the reaction can proceed in the wet phase, that is to say on a starch suspension, in an aqueous medium or in a solvent medium, but also in the dry phase in the presence of a catalyst of alkaline type. Preferably the solvent phase or the dry phase is selected in the case where the solubility in water becomes large when the DS increases. The fixation can also be performed during solubilization of the starch under the conditions described above.

The reactions of fixation to the starch of these cationic or anionic groups have been carried out and described with starches from all sources such as those from corn, rice, wheat, potato, manioc and the like. They may be carried out, according to an advantageous embodiment of the invention, on starches which have been previously submitted to a more or less complete cross-linking treatment. This treatment awards the anionic or cationic starches thus obtained with special properties due to which the possibility of choice of their addition point within the frame of the invention is enlarged.

In a preferred embodiment of the invention, Applicants have been able to observe, at the level of the anionic starches and of the cationic starches employed, more or less perceptible behavior differences, as a function particularly of the cellulose pulps and of the aqueous media used.

It is generally cationic potato starch which is recognized as contributing the best performance. A very particular preference is given to anionic starches belonging to the group of sulfocarboxyalkyl derivatives.

The remarkable colloidal properties of the starches employed according to the invention have important repercussions on the manufacture of paper, enabling, for example, improvement in the retention of cellulose fines and of fillers during the fabrication of the sheet and the drainage speed of water through the sheet.

Within the scope of the process according to the invention, other additives could also be used, like for example, floculating agents traditionally used in papermaking such as, for example, aluminum sulfate, Al polychloride, polyethylene-imine, polyacrylamide and the like.

Finally, the invention could be better understood by means of the examples which follow and which either are comparative, or relate to advantageous embodiments.

DESCRIPTION OF PREFERRED EMBODIMENTS

To evaluate the results obtained by employing the process according to the invention, recourse is had to an installation adapted to reproduce at least certain steps in the manufacture of paper from cellulose fibers and shown diagramatically in the single FIGURE.

The installation concerned comprised a tub 1 within which is prepared the composition comprising a mass of fibers which is in suspension and homogenized by means of a stirrer 2. The stirring is kept up throughout the test so as to ensure the complete regularity of supply of the circuit. It is however sufficiently gentle not to modify over time the state of refining of the fibrous composition under study and not to degrade the flock.

Once prepared, the fibrous composition is led through a pipe 3 equipped with a pump $P_1$ into a transit tub 4 provided with a stirrer 5 and in which it can be kept for a predetermined time to permit contact with one or several of the adjuvants employed at this stage; it is also possible to provide for no dwell in the vat 4; in this case, the fibrous composition simply passes through the vat and is led through a pipe 6 directly to a pump $P_2$ situated at the outlet from the tub 4.

In all cases, the fibrous composition will be withdrawn from the tub 1 with a strictly constant flow rate.

Downstream of the pump $P_1$, the pipe 3 is equipped with a vessel 7 within which it is possible to adjust the pH of the fiber suspension by the addition of alkali or of acid; and downstream of vessel 7, the pipe 3 comprises an element shown diagramatically at 8 and adapted to permit the introduction of one or of several adjuvants into the fibrous composition.

The pump $P_2$ conducts the fiber suspension through a pipe 9 equipped with two mixers in series respectively $M_1$ and $M_2$ equipped with stirrers respectively 10 and 11; the regulation of the rotary speeds and the shape of the blades of the stirrers 10 and 11 are selected so that the conditions existing within the mixers are as close as possible to shearing conditions existing in the wet end of an industrial paper manufacturing plant.

Three elements shown diagramatically at 12, 13 and 14 are adapted to permit the introduction of adjuvants into the fibrous composition are placed in the pipe 9 at the outlet from the pump $P_2$ for the first and respectively before the inlet of the mixers $M_1$ and $M_2$ for the two others; these elements enable selection of the order of introduction, of the conditions before or after addition and of the contact times between the adjuvants and the fibrous composition.

The second mixer $M_2$ is connected through a pipe 15 to a measuring apparatus 16 called a "Britt-Jar" in the art, described in the following publications:

TAPPI, October 1973, Volume 56, No. 10, p. 46–50
TAPPI, February 1976, Volume 59, No. 02, p. 67–70
TAPPI, July 1977, Volume 60, No. 07, p. 110–112
TAPPI, November 1978, Volume 61, No. 11, p. 108–110

(TAPPI = Technical Association of the Pulp and Paper Industry) and adapted to imitate the drainage of the paper pulp on the web of the paper machine.

At the outlet from the "Britt-Jar", drainage waters are recovered in vessel 17 which can be compared with what is called "white waters" in the art of paper manufacture, an expression which will be used in the following.

The white waters recovered in vessel 17 are for one part, discarded to the sewer through a pipe 18, for another part, recycled through a pipe 19 equipped with a pump $P_3$ to the pipe 9 at a point 20 situated between the elements 12 and 13.

The vessel 17 is connected, in addition, to a secondary installation enabling the leading through a pipe 21 equipped with a pump $P_4$ of a third part of the white waters contained in said vessel to a turbidimeter 22 at the outlet of which the white waters which have passed through it is brought back to the vessel 17 through a pipe 23.

Complete homogenization of the white waters is ensured in this secondary installation.

The turbidimeter 22 enables the content of the white waters in inorganic and organic materials (fibers, fillers and the like) to be evaluated; it happens in fact that the measurements carried out continuously by means of this apparatus are in direct relationship with the retention and more or less proportional to the amount of soluble and insoluble materials present in the white waters.

Recourse has also been had to a photometer which may be that known under the trademark NANO-COLOR 50D (manufactured by the Macherey-Nagel Company, 5160-Duren, German Federal Republic, and marketed by the Société Techmation, 20 Quai de la Marme, 75019 Paris), and which permits measurements to be carried out expressing the over-all fixation level of starches; the principle of these measurements is based on the expression of the difference between the measurement carried out on a supernatant freed by some minutes of rest from cellulose fibers and fillers, and dyed with iodine, and that performed on the same undyed supernatant.

EXAMPLE 1

For a first series of tests, a paper pulp of the so-called "acid medium" type was prepared by means of the following principal constituents:

35% of soda pulp—long fiber,
35% of soda pulp—short fiber,
15% of "coated broke" (that is to say recycled pulp) filled with calcium carbonate,
15% of "coated broke" filled with kaolin.

After refining the mixture so-obtained in potable water at 48° SR (Schopper-Riegler degree, AFNOR NF Q 50-003 standard), there is introduced therein:

35% of kaolin (grade G),
4% of aluminium sulfate.

The fibrous composition or pulp so prepared had the following characteristics:

concentration of the pulp before introduction of the fillers (kaolin and aluminium sulfate): 8 g/kg,
concentration of the filled pulp: 10.6 g/kg
pH 4.7 (in the tub)
resistivity: 623 Ω-cm
acidity: 140 mg/l (reckoned as sulfuric acid).

The acidity was measured by simple titration from an N/10 sodium hydroxide solution with, as colored indicator, phenolphthalein.

Several experiments were carried out by treating this pulp by means of a cationic starch and then by means of an anionic starch.

As cationic starch, there was used a cationic potato starch having a fixed nitgrogen content to dry matter comprised between 0.55% and 0.60% (which corresponds to a DS comprised between 0.063 and 0.069); in the event it was that marketed by the Assignee under the trademark HI-CAT® 180.

For its application, this cationic starch has been solubilized on a continuous cooking apparatus, under the following conditions:

milk with 10% commercial matter
temperature: 120° C. at a sufficient pressure for the cooking to take place in liquid phase.
standing time: 30 seconds,
in line dilution with cold water to bring the refractometric reading to less than 0.5%.

As anionic starches, those identified below were used:

a potato starch sulfosuccinate having a DS of 0.05 (in the event that marketed by the Assignee under the trademark VECTOR® A 180),
a sulfated potato starch of DS of 0.087, referenced by the symbol AS,
a phosphated potato starch of DS about 0.04 (in the event that marketed by the Company AVEBE under the trademark RETABOND AP).

The anionic starches studied were prepared by cooking with steam in an open tub under the following conditions:

milk with 4% commercial matter
standing for 5 minutes at 95°–98° C.
in line dilution with cold water to bring the refractometric reading to 2%.

The installation described above with respect to the single Figure was used.

The operating parameters of the installation have been defined as follows:

the rotary speeds of the mixers $M_1$ and $M_2$ were respectively 1000 and 2000 rpm,
the delivery rates of the pumps $P_1$, $P_2$ and $P_3$ (the return of the white waters) were 400 milliliters per minute),
the adjustment of the turbidimeter: variable amplifier ×5.

The respective addition points of the cationic starch and of the anionic starches studied were selected arbitrarily.

The cationic starch HI-CAT® 180 was introduced through the element 8, whence a contact time of 5 minutes before passage over "Britt-Jar".

The anionic starches were introduced through element 12, whence a contact time of 30 seconds before passage over "Britt-Jar".

The amount of cationic starch used was 1% dry with respect to the dry fibrous composition.

For the anionic derivatives, the fixed amount was that permitting the lowest turbidimetric reading.

The number of experiments performed was five, namely:

TEST 1: Control (without starch)

TEST 2: HI-CAT® 180 alone (1%)

TEST 3: HI-CAT® 180 (1%); VECTOR® A 180 (1.5%)

TEST 4: HI-CAT® 180 (1%); AS (1.6%)

TEST 5: HI-CAT® 180 (1%); RETABOND AP (0.65%).

The measurements carried out were the following:

measurement of the turbidity of the white waters, the evaluation of the over-all proportion of fixed starch by means of the photometer, measurement of the quantity of fibers and fillers retained, commonly denoted by "first pass retention"

measurement of the retention of fillers.

The "first pass retention" is expressed by the ratio $$R_W = \frac{\text{Concentration of fibers and fillers of the fibrous composition} - \text{Concentration of fibers and fillers of the white waters}}{\text{Concentration of fibers and fillers of the fibrous composition}} \times 100$$

The retention of the fillers is expressed by the ratio $$R_F = \frac{\text{Concentration of fillers of the fibrous composition} - \text{Concentration of fillers of the white waters}}{\text{Concentration of fillers of the fibrous composition}} \times 100$$

The results of these measurements are collected in Table I.

TABLE I

| Tests | Turbidity (white waters) | Photometer reading (starch) | First pass retention % | Fillers retention % |
|---|---|---|---|---|
| 1 | 66.5 | 0.071 | 80.6 | 68.2 |
| 2 | 70.5 | 0.186 | 79.2 | 66.7 |
| 3 | 23.5 | 0.208 | 94 | 82.7 |
| 4 | 41 | 0.157 | 86.45 | 74.4 |
| 5 | 63.5 | 0.583 | 79.3 | 65.7 |

ph: 4.4–4.5 ($H_2SO_4$)

The results presented in Table I show that the sequential introduction of anionic starch of the sulfated type and more particularly of the sulfosuccinate type and of cationic starch enables the retention of fibers and of fillers to be significantly increased whilst ensuring complete fixation of the amylaceous material employed.

This fixation of the starches is all the more remarkable as the concentration of starchy materials employed in tests 3 and 4 is at least double that introduced in test 2.

It is observed on the other hand that the results obtained in the presence of phosphated potato starches are distinctly less satisfactory particularly from the point of view of fixation of the starch (cf. photometric reading) and of the retention of fillers.

EXAMPLE 2

For this second series of tests, was taken up from an industrial machine, a thick pulp of the so-called "acid medium" type, based on old paper, which, diluted with clarified liquors coming from the same plant, provided pulp introduced into the tub and whose properties were the following:

total concentration: 12.55 g/l, concentration of soluble matter: 3.7 g/l, pH: 6.10, resistivity: 438 Ω-cm, hardness: 174° TH, starch in the filtrate: less than 0.1 g/l, soluble calcium: 575 mg/l, soluble aluminum: 2 mg/l, ash at 900° C.: 2.2 mg/l.

In this series of tests, the cationic starch employed was that of Example I, prepared under the same conditions.

The anionic starch employed was the sulfated potato starch of Example I. It was prepared by cooking with steam in an open tub under the following conditions:

milk with 5% commercial matter, standing for 5 minutes at 95°–98° C., in line dilution with cold water to bring the refractometric reading to 2%.

The installation was that of the single FIGURE.

The operating parameters of the installation were defined as follows:

mixer $M_1$: stirring at 1000 rpm, mixer $M_2$: stirring at 2000 rpm, the delivery rates of the pumps $P_1$ and $P_2$ were 500 milliliters per minute, the delivery rate of the pump $P_3$ was 400 milliliters per minute, the excess being discarded through the pipe 18, the pH was maintained at 5.7 with dilute sulfuric acid, introduced into the white waters led in for dilution.

The respective addition points of the cationic starch and of the anionic starch were selected as follows:

the cationic starch was introduced through the element 8 (contact time 10 minutes) and a complementary amount was, in certain tests, introduced through the element 14, the anionic starch was introduced through the element 12.

The amounts of cationic starch and of anionic starch and the addition point are indicated in Table II.

TABLE II

| Test | Amount introduced through element 8 | Amount introduced through element 14 | Amount introduced through element 12 |
|---|---|---|---|
| 6 (control) | | | |
| 7 | 1% HI-CAT 180 | 0.5% HI-CAT 180 | |
| 8 | 1.5% HI-CAT 180 | 0.5% HI-CAT 180 | |
| 9 | 2.5% HI-CAT 180 | 0.5% HI-CAT 180 | |
| 10 | 2% HI-CAT 180 | | 1% AS |
| 11 | 2% HI-CAT 180 | | 1.5% AS |

The amounts of cationic and anionic starch are expressed dry with respect to the dry fibrous composition contained in the tub 1.

The measurements carried out were those of the turbidity of the white waters, of the first pass retention and of the amount of starch (in mg/l) found in the white waters determined by enzymatic titration.

The results are collected in Table III.

TABLE III

| Test | Turbidity (white waters) | First pass retention | Starch (white waters, in mg/l) |
|---|---|---|---|
| 6 (control) | 93 | 79.6 | 60.9 |
| 7 | 99 | 79.5 | 73.7 |
| 8 | 110 | 78.6 | 97.8 |
| 9 | 120 | 78.6 | 151.2 |
| 10 | 102 | 80.4 | 85.3 |
| 11 | 106 | 80.7 | 98.1 |

The pH of the white waters was 5.7 to 5.8.

In light of these results, it is observed that the correct fixation limit of the cationic starch used, introduced at two points as specified above, is situated towards 2% (see test 8), when cationic and anionic starches are used successively, for equivalent results starch ratios of the order of 3.5% may be expected; the gain in retention may then be 3 points, which, in the system used, is important.

As additional experiment, the fibrous composition was taken up after the second mixer, instead of proceeding with measurements on the "Britt-Jar" and "formettes" were prepared (paper sheets) of grammage of about 150 gm/m$^2$ by means of this pulp using equipment of the RAPID-KOETHEN type marketed, for example, by the Socieété Enrico Toniolo SpA (Milan, Italy) and well-known to the technician skilled in the art.

The pulp studied being essentially intended for paper intended to be corrugated, the CMT 60 was measured, that is to say the Concora index (see the TAPPI standard T 809 su 66), the results being collected in Table IV.

TABLE IV

| Test | CMT 60 (Newtons) |
|---|---|
| 6 | 151 |
| 7 | 183 |
| 8 | 196 |
| 9 | 193 |
| 10 | 188 |
| 11 | 222 |

It is observed, on reading these results, that the gain in CMT is almost proportional to the amount of fixed transformed starch. The use of 2% of cationic starch enables the CMT to be increased by 45N (test 8). The overall use of 3.5% of converted starch (test 11) enables an over-all gain of 71N, which constitutes a determinative advantage of the process according to the invention.

EXAMPLE 3

In this example, the cationicity of the starch is varied.

A thick pulp obtained from old paper was taken up in an industrial machine, then diluted with white waters coming from the same machine to constitute the fibrous composition intended to supply the installation according to the single FIGURE.

Analysis of said composition leads to the following values:

total concentration: 16.5 g/l
concentration of soluble matter: 4.8 g/l
pH: 5.7
acidity: 253 mg/l reckoned in sulfuric acid
resistivity: 338 Ω-cm
soluble aluminum: 3 mg/l
soluble sodium: 310 mg/l
soluble calcium: 650 mg/l
soluble magnesium: 24 mg/l
starch: 0.39 g/l
reducing sugars: 0.12 g/l
ash at 900° C.: 2.8 g/l.

A first cationic starch was employed, namely that of Example 1, which was prepared by cooking in a continuous cooker.

A second cationic starch, namely a cationic starch having an average DS of 0.12 (1% fixed nitrogen) denoted by the reference AMIDON 608, was also used.

The anionic starch employed was one of those used in Example 1, namely the potato starch sulfosuccinate VECTOR ® A 180.

The AMIDON 608 and the VECTOR ® A 180 were cooked in an open tub with live steam (5 minutes at 95-98%) from a milk with 4% commercial dry matter. The sizes thus obtained were then diluted to 2% with cold water.

The installation used was that shown in the single FIGURE.

The operating parameters of this installation have been defined as follows:

mixer $M_1$: stirring of 1000 rpm, mixer $M_2$: stirring of 2000 rpm, the delivery rates of pumps $P_1$ and $P_2$: 500 milliliters per minute; the delivery rate of pump $P_3$: 400 milliliters per minute; the excess is removed.

The cationic starches were introduced through the element 8, which gave a contact time of 5 minutes.

The anionic starch was introduced through the element 12, which gave a contact time of 30 seconds.

As already indicated above, the amounts of anionic starch used were those for which the turbidimetric reading was the lowest.

Five tests were performed (12 to 16), the amounts of starch introduced being:

TEST 12: mil (control test)
TEST 13: 1.5% of AMIDON 608
TEST 14: 1.5% of HI-CAT ® 180
TEST 15: 2% of AMIDON 608
TEST 16: 2% of AMIDON 608+0.96% of VECTOR ® A 180.

Measurements of the turbidity and measurements of the first pass retention were carried out and the over-all proportion of starch fixed in the white waters was evaluated.

The results are collected in Table V.

TABLE V

| Test | Turbidity (white waters) % | Photometer reading (starch) | First pass retention |
|---|---|---|---|
| 12 | 42 | 2.215 | 81 |
| 13 | 37.5 | 1.675 | 84.3 |
| 14 | 44 | 2.660 | 81.5 |
| 15 | 36.5 | 2.09 | 84.5 |
| 16 | 32 | 1.675 | 87.4 |

The pH of the white waters was 6.2 to 6.4.

Tests 13, 14 and 15 (cationic starch alone) demonstrate clearly that, under the condition adopted for this example, the use of a cationic starch of higher DS enables the retention to be increased whilst making the white waters clearer.

Test 16 shows that the successive employment of a cationic starch of the AMIDON 608 type and of an anionic starch leads to very clear white waters in spite of high starch doses (about 3%) and to excellent retentions. Moreover, the amount of fixed starch is remarkable.

EXAMPLE 4

Within the scope of this example, a type of fibrous composition was used other than those envisaged until now; it was a so-called "acid medium" pulp, but filled, in the event with kaolin.

The composition was taken up on an industrial machine, then diluted with white waters coming from the same machine.

Analysis of the preparation so obtained gave the following elements:

total concentration: 11 g/l
concentration of soluble matter: 0.86 g/l
pH: 5.6
acidity in $H_2SO_4$: 20 mg/l
resistivity: 1917 Ω-cm
reducing sugars: 0 g/l
soluble starch: 0.31 g/l
soluble aluminum: 1 mg/l
ash at 900° C.: 1.6 g/l.

There was employed as cationic starch, a cationic potato starch having a ratio of fixed nitrogen to dry matter comprised between 0.35 and 0.40 (namely a DS comprised between 0.04 and 0.046), in the event that marketed by the Assignee under the trademark HI-CAT® 142.

The method of preparation suitable for its employment is that described for cationic potato starch HI-CAT® 180.

In addition, there was used, as anionic starch, the anionic potato starch VECTOR® A 180, already described in Example 1.

The installation shown in the single FIGURE was again used.

The operating parameters of the installation are defined as follows:

mixer $M_1$: stirring of 1000 rpm,
mixer $M_2$: stirring of 2000 rpm,
delivery rates of pumps $P_1$, $P_2$ and $P_3$: 400 ml/minute.

The cationic starch was introduced through element 8, which gave a contact time of 5 minutes.

The anionic starch was introduced through element 12, which gave a contact time of 30 seconds.

Three tests followed (17 to 19), the amounts of cationic and anionic starch introduced being:

TEST 17: Control (nil)
TEST 18: 1.2% of HI-CAT® 142
TEST 19: 1.2% of HI-CAT® 142–0.66% of VECTOR® A 180.

The turbidity, the first pass retention, the fillers retention were measured and the proportion of starch fixed estimated by photometry.

The results are collected in Table VI.

TABLE VI

| Test | Turbidity | First pass retention % | Retention fillers % | Photometer reading (starch) |
|---|---|---|---|---|
| 17 | 79 | 86.9 | 77.3 | 2.46 |
| 18 | 72 | 88.1 | 78.4 | 2.66 |
| 19 | 35.5 | 94.5 | 90.6 | 2.57 |

It is concluded from this table that the sequential employment of anionic starch and of cationic starch enables from the point of view of retention, the production of remarkable results whilst impoverishing considerably the white waters.

The fixing of the starches to the fibers therein is likewise improved,.

EXAMPLE 5

Another series of tests was followed using an unfilled paper pulp processed in neutral medium.

The basic composition was here:

40% of bleached Kraft
15% of bleached ground-wood—long fiber
45% of bleached ground-wood—short fiber.

By diluting the thick industrial pulp with white waters coming from a machine, the preparation was obtained by which the installation in the single FIGURE was supplied.

Analysis of this preparation gave the following values:

total concentration: 12.5 g/l
concentration of soluble matter: 1 g/l
pH: 5.8
acidity in $H_2SO_4$: 21 mg/l
resistivity: 1542 Ω-cm
reducing sugars: 0.17 g/l
soluble starch: 0.38 g/l
soluble aluminum: 0.6 mg/l
ash at 900° C.: 3.3 g/l.

There was employed, by using the installation according to the single FIGURE, as cationic starch, that known under the trademark HI-CAT® 142 and, as anionic starch, that known under the trademark VECTOR® A 180.

The operating parameters of the installation were as follows:

mixer $M_1$: stirring of 1000 rpm,
mixer $M_2$: stirring of 2000 rpm,
delivery rates of pumps $P_1$, $P_2$ and $P_3$: 400 ml/minute.

The pH was adjusted to a value of 7–7.2 by the introduction of dilute NaOH at the level of junction 20 of pipes 19 and 9.

In addition, the cationic starch was introduced through the element 8, which gave a contact time of 5 minutes.

The anionic starch was introduced through element 12, which gave a contact time of 30 seconds.

Three tests were carried out (20 to 22), the nature and the amounts of starch introduced being:

TEST 20: Control (nil)
TEST 21: 1.2% of HI-CAT° 142 and
TEST 22: 1.2% of HI-CAT® 142–0.5% of VECTOR® A 180.

The amount of anionic starch was selected so that the lowest turbidimetric reading was obtained.

The physical tests performed on the papers obtained from tests 20 to 22, namely the determination:

of the grammage (in g/m²)
of the Scott-Bond (in Joules/m², TAPPI T 506 su 68 standard)
of the ash (in %) led to the results collected in Table VII.

TABLE VII

| Test | Grammage (in g/m²) | Scott-Bond (in Joules/m²) | Ash (in %) |
|---|---|---|---|
| 20 | 105 | 168 | 15.9 |
| 21 | 115 | 239 | 17.8 |
| 22 | 118 | 330 | 19.2 |

The values collected in Table VII show that the results obtained are remarkable.

What is claimed is:

1. In a process for manufacturing paper from a fibrous pulp composition comprising recycled cellulosic fibers, in an installation including a wet end, wherein starch is fixed in said fibrous pulp composition, the improvement comprising successively introducing into the said fibrous pulp composition separately from one another at at least two points of said installation, about 0.2% to 5.0% by weight expressed as dry starch with respect to said dry fibrous composition of at least one cationic starch, and about 0.2% to 5.0% by weight expressed as dry starch with respect to said dry fibrous composition of at least one anionic starch other than starch phosphate, the proportion of cationic starch with respect to anionic starch being comprised between 5/1 and ⅓, this ratio being expressed as a dry weight of starch, whereby the limiting threshold of fixation of said starch in said pulp is increased by at least 30% over the amount of starch which is fixed when cationic starch is used alone.

2. Process according to claim 1 wherein the at least two points are located within the wet end.

3. Process according to claim 1 wherein the cationic starch is selected from the group consisting of those having an acceptor electron state, obtained by means of substituent groups of an electropositive nature, the substituents used containing a tertiary or a quaternary nitrogen atom, a phosphonium or a sulfonium group.

4. Process according to claim 1 wherein the cationic starch has a degree of substitution at the most equal to 0.3.

5. Process according to claim 1 wherein the cationic starch has a degree of substitution comprised between 0.02 and 0.20.

6. Process according to claim 1 wherein the cationic starch has a degree of substitution comprised between 0.04 and 0.15.

7. Process according to claim 1 wherein the anionic starch is selected from the group consisting of starch phosphonates and carboxyalkylated starches.

8. Process according to claim 1 wherein the anionic starch is selected from the group consisting of starch sulfates, sulfoalkylated and sulfocarboxyalkylated starches.

9. Process according to claim 1 wherein the anionic starch has a degree of substitution at the most equal to 1.5.

10. Process according to claim 1 wherein the anionic starch has a degree of substitution at the most equal to 0.5.

11. Process according to claim 1 wherein the amounts of cationic and anionic starch employed are comprised between 0.4 and 3%, the percentages being expressed as dry starch with respect to the dry fibrous composition.

12. Process according to claim 1 wherein the amounts of cationic and anionic starch employed are comprised between 0.7 and 2.5%, the percentages being expressed as dry starch with respect to the dry fibrous composition.

13. Process according to claim 1 wherein the cationic and anionic starches are introduced into the fibrous composition in the form of a dilute aqueous size or glue of concentration comprised between 5% and 0.01%.

14. Process according to claim 1 wherein the cationic and anionic starches are introduced into the fibrous composition in the form of a dilute aqueous size or glue of concentration comprised between 3% and 0.01%.

15. Process according to claim 1 wherein the cationic and anionic starches are introduced into the fibrous composition in the form of a dilute aqueous size or glue of concentration comprised between 1% and 0.01%.

16. Process according to claim 1 wherein the proportion of the cationic starch with respect to the anionic starch is comprised between 3/1 and ½, this ratio being expressed as a dry weight of starch.

* * * * *